United States Patent [19]

Childers

[11] Patent Number: 4,919,828

[45] Date of Patent: Apr. 24, 1990

[54] FIBER LUBRICANTS CONTAINING HIGH MOLECULAR WEIGHT POLYACRYLAMIDO ALKANE SULFONIC ACID ADDITIVES

[75] Inventor: John Childers, Monroe, N.C.

[73] Assignee: Henkel Corporation, Ambler, Pa.

[21] Appl. No.: 336,589

[22] Filed: Apr. 10, 1989

Related U.S. Application Data

[63] Continuation of Ser. No. 115,234, Oct. 30, 1987, abandoned.

[51] Int. Cl.[5] ..... D06M 15/00

[52] U.S. Cl. ..... 252/8.75; 8/115.6; 8/DIG. 1; 8/DIG. 21; 252/8.6

[58] Field of Search ..... 252/8.75, 8.6, 8.8; 525/212; 524/487; 8/115.6

[56] References Cited

U.S. PATENT DOCUMENTS

| | | | |
|---|---|---|---|
| 3,180,750 | 4/1965 | Shipee et al. | 8/115.61 |
| 3,275,561 | 9/1966 | Pye et al. | 424/73 |
| 3,772,069 | 11/1973 | Daniel | 106/287.14 |
| 4,128,631 | 12/1978 | Lundmark et al. | 424/73 |

FOREIGN PATENT DOCUMENTS

| | | |
|---|---|---|
| A1-3447421 | 6/1986 | Fed. Rep. of Germany . |
| 61-041374 | 7/1986 | Japan . |
| 59232191 | 7/1986 | Japan . |

*Primary Examiner*—Paul Lieberman
*Assistant Examiner*—John F. McNally
*Attorney, Agent, or Firm*—Ernest G. Szoke; Wayne C. Jaeschke; Henry E. Millson, Jr.

[57] ABSTRACT

Fiber lubricants comprising a lubricating emulsion and a high molecular weight acrylamidoalkane sulfonic acid polymer are provided. The lubricants, especially those banded on low-friction silicone lubricating emulsions, are characterized by excellent low wet friction properties, particularly on cotton fibers.

22 Claims, No Drawings

FIBER LUBRICANTS CONTAINING HIGH MOLECULAR WEIGHT POLYACRYLAMIDO ALKANE SULFONIC ACID ADDITIVES

This application is a continuation of application Ser. No. 115,234, filed Oct. 30, 1987, now abandoned.

BACKGROUND OF THE INVENTION

1. Field of the Invention

This invention relates to fiber lubricants, and more particularly relates to fiber lubricants that contain an acrylamidoalkane sulfonic acid polymer additive.

2. Discussion of Related Art:

Textile yarns are customarily treated before processing to reduce fiber-to-metal friction, i.e., that friction generated between the moving yarn and the metal elements of knitting or other processing apparatus. While untreated yarns may have a standard coefficient of friction ($\mu$) of 0.250 or higher, fiber lubricants in general use substantially reduce this friction level.

The standard low friction lubricant for textile spun yarns is a paraffin or polyethylene wax-emulsion lubricant of the type commercially available as Stantex W.E. 567 TM, a product of Henkel Corp., Charlotte, NC. While lubricants of this type have proved broadly useful in a variety of conventional textile applications to attain acceptably low yarn friction levels, specialized technology has made greater demands on fiber-to-metal lubricants. In particular, high-speed knitting apparatus used to knit cotton yarn at yarn speeds of from about 800 to 1200 rpm or m/min has generated friction levels which are not satisfactorily reduced by these standard wax-emulsion type lubricants. This problem is exacerbated when textile yarns are wet-processed, as is frequently the case, since processing friction levels increase as the yarn moisture level rises. This effect is particularly pronounced with wet cotton yarn.

It is thus desirable to provide an improved lubricant for textile yarns to reduce fiber-to-metal friction during processing, and, in particular, to provide a lubricant which imparts substantially uniform low yarn friction effects regardless of yarn moisture level.

DETAILED DESCRIPTION OF THE INVENTION

The invention accordingly provides a fiber lubricant for reducing fiber-to-metal friction during processing of textile yarns comprising a low-friction lubricating component, typically in the form of an emulsion, and a high molecular weight polyacrylamidoalkane sulfonic acid additive.

Preferably, the low-friction lubricating component is a low-friction non-ionic silicone emulsion comprising an emulsion of a silicone elastomer in water, as the combination of a silicone-based emulsion and the polymer additive provides a dramatic reduction in friction coefficient over standard wax-emulsion type lubricants. Useful silicone emulsions are exemplified by Repellan 80 TM, a product of Henkel Corp., New York, New York. Other suitable commercially available silicone emulsions include Dow Corning 1111 Emulsion TM, available from Dow Corning Corp., Midland, Michigan; and Masil EM 217-36 TM, available from Mazer Chemicals, Inc., Gurnee, Illinois. Alternatively, the polymer additive is combined with a non-silicone lubricating component, such as an emulsion of a paraffin or polyethylene wax in water, although the improvement in lubrication as compared to standard wax-emulsion type lubricants containing no additive will typically not be so great. Low friction lubricating emulsions of the type useful herein are known in the textile art, and also in unrelated arts such as well-drilling technology.

The polymer additive of the invention comprises an acrylamidoalkane sulfonic acid polymer, preferably employed in the form of one of its salts of adequate water solubility, as the free acid tends to be corrosive. Examples of such salts include the alkali metal salts, e.g., sodium and potassium, and amines such as ammonia, methylamine and fatty amines having from 6 to 18 carbon atoms. The alkane moiety preferably contains from 1 to 6 carbon atoms. Useful polymers are those having a number average molecular weight in the range of from about 500,000 to about 10,000,000. Preferably the mw is at least about 1,000,000, as below this weight, a greater amount of additive is required to achieve at best similar effects. At molecular weights below about 500,000, excessive amounts of polymer are required to attain acceptably reduced friction levels, causing unacceptably high dry yarn residues with resulting high dry yarn friction. A particularly preferred mw range is from about 3 to 4 million.

Suitable high molecular weight polymers for use in the lubricants of the invention include the acrylamidomethylpropane homo-polymers commercially available as Lubrizol 2420 TM, a product of Lubrizol Corp., Wickliffe, Ohio, and as Rheothik Polymer 80-11 TM, a product of Henkel Corp., New York, New York. The polymers and their production are well-known. In general, acrylamido-$C_1$-$C_6$-alkane sulfonic acid homopolymers are used, although copolymers which comparably function are also contemplated. The additive is conveniently employed in the form of its sodium salt.

Generally, the polymer is added to the lubricating component to provide a concentration of at least about 0.01% w/w polymer, based on the total weight of the lubricant, including the solvent or suspension medium for the lubricating component and emulsifiers, if any, and optional ingredients. The upper limit on the amount of additive employed comprises, as a practical matter, that amount which is still compatible with the other lubricant ingredients, especially lubricating silicone emulsions. Typically, concentrations will range up to about 1.5% w/w polymer, based on the total weight of the lubricant. Usually, concentrations of additive toward the higher end of this range are used when the polymer has a molecular weight toward the lower end of the molecular weight range described above, and, conversely, concentrations of additive toward the lower end of the stated range are used when the polymer has a molecular weight toward the higher end of the range.

The lubricant of the invention, in addition to the polymer additive and the lubricating emulsion, typically further includes standard additives in effective amounts, such as corrosion inhibitors or bacteriostats. Additionally, the lubricating effect can be increased if desired by combination of the lubricant of the invention with known fiber lubricants such as paraffin or polyethylene waxes or wax emulsions, mineral oil, or fatty acid esters.

The advantages of the lubricant of the invention are particularly realized with 100% cotton yarn, which is customarily packed and processed "wet", i.e., at natural moisture retention levels. Since cotton has a relatively high moisture regain level (mill specifications generally require a regain level of 6 to 8%), wet friction generated during processing of cotton yarns, especially during high-speed knitting operations, is a particular problem. The lubricants of the invention are particularly adapted for the reduction of wet friction, and are thus especially effective for use on wet cotton fibers, including bleached or dyed 100% cotton yarn, or cotton blend yarn (typically at least about 20% cotton with the remainder synthetic fibers). However, the lubricants are also useful for a broad range of wet or dry fibers, both natural and synthetic, including polyester, rayon, nylon, and acrylic fibers, or blends thereof.

The lubricants of the invention are applied to the fibers in amounts sufficient to reduce friction coefficients to the desired level, without leaving undesirably high residues on the fibers. Generally, amounts of lubricant applied will broadly correspond to amounts of wax-emulsion type lubricants customarily employed for a particular fiber type and operating condition.

The following Examples are provided to illustrate the practice of the invention.

MATERIALS

1. Acrylamidoalkane sulfonic acid polymer additive a. Polymer A: Homopolymer of acrylamidomethylpropane sulfonic acid, sodium salt. Number average molecular weight of 3 to 4 million; inherent viscosity 5 to 6 dl.g.$^{-1}$ (0.1 g. polymer/100 ml 0.5 N NaCl); density @ 60° F.: 1.00 kg./l; pH 7–9. Employed herein as Lubrizol 2420 TM, a product of Lubrizol Corp., Wickliffe, Ohio.

b. Polymer B: Homopolymer of acrylamidomethylpropane sulfonic acid, sodium salt. Number average molecular weight range 1 to 2 million. Viscosity 200,000 cps (approx.) at 0.5% active solution: 2.5 rpm = 200 cps, 2.0 rpm 150 cps; acid number 41–45; pH 0.5–1.0 at 0.5% active solution. Surface tension (1% active solution) 79.8 dynes/cm, interfacial tension (1% active solution) 22.6 dynes/cm (water and trichloromethane). Viscous clear liquid 2. Lubricating component (as emulsion)

a. Emulsion A: 21% emulsion of mineral oil and paraffin wax in water, pH 8.0. Anionic. Miscible in cold water. Employed herein as Stantex W.E. 567 TM, a product of Henkel Corporation, New York, NY.

b. Emulsion B: 40% emulsion of silicone elastomer in water, pH 9.2. Nonionic. Miscible in cold water adjusted to pH 5 to 7. Employed herein as Repellan 80 TM, a product of Henkel Corporation, New York, NY.

c. Emulsion C: 21% emulsion of fatty ester and paraffin wax in water, pH 8.0. Anionic. Miscible in cold water. Employed herein as Stantex W.E. 214 TM, a product of Henkel Corporation, New York, NY.

d. Emulsion D 40% emulsion of silicone elastomer in water, pH 7.0, nonionic, miscible in water. Employed herein as Dow Corning 1111 emulsion from Dow Corning Corp., Midland, Mich.

3. Lubricants according to the invention (all amounts are in percent by weight of total lubricant)

| | | |
|---|---|---|
| a. Lubricant A | | |
| Emulsion B | 24.92 | |
| Polymer A | 0.17 | (30% in water/hydrocarbon) |
| Water | 74.91 | |
| | 100.00 | |
| b. Lubricant B | | |
| Emulsion B | 24.40 | |
| Polymer B | 1.00 | |
| Water | 74.50 | |
| | 100.00 | |
| c. Lubricant C | | |
| Emulsion C | 99.90 | |
| Polymer A | 0.10 | |
| | 100.00 | |
| d. Lubricant D | | |
| Emulsion D | 24.40 | |
| Polymer A | 0.17 | |
| Water | 74.91 | |
| | 100.00 | |

METHODS

Fiber-to-metal friction coefficients of wet and dry yarns were measured by a standard Lawson-Hemphill instrument at 50 m/min. The results for lubricants of the present invention and prior art lubricants are given in Tables I–II.

TABLE I

100% 16′ s/2 cotton yarn (dyed, wet)

| Lubricant | Lawson-Hemphill Friction Coefficient (μ) |
|---|---|
| Untreated Control* | 0.260 |
| Emulsion A* | 0.200 |
| Emulsion B | 0.170 |
| Emulsion C* | 0.183 |
| Emulsion D | 0.170 |
| Lubricant A (Emulsion B + polymer) | 0.140 |
| Lubricant B (Emulsion B + polymer) | 0.140 |
| Lubricant C (Emulsion C + polymer) | 0.176 |
| Lubricant D (Emulsion D + polymer) | 0.140 |

*Comparison Examples. Emulsions A and C are known prior art fiber lubricants (see MATERIALS, supra.).

TABLE II

16′ s/1 50/50 polyester/cotton yarn (yellow dyed, dry)

| Lubricant | Wet Pickup (%)** | Lawson-Hemphill Friction Coefficient (μ) |
|---|---|---|
| Emulsion A* | 5.30 | 0.17 |
| Emulsion C* | 5.02 | 0.15 |
| Lubricant A | 4.90 | 0.11 |
| Emulsion A* | 2.33 | 0.19 |
| Emulsion C* | 2.40 | 0.15 |
| Lubricant A | 2.48 | 0.12 |
| Untreated Control* | — | 0.24 |

*Comparison Examples (see TABLE I).
**Wet pickup was set at about 2.5 and 5%. 10% active emulsion.

RESULTS

It is clear from the above Tables that the friction coefficients of the lubricating emulsions on the tested yarns are greatly improved by the addition of the polymer additives of the invention. In particular, lubricants comprising a silicone-based lubricating emulsion and polymer additive (Lubricants A and B) showed a 30% reduction in the friction coefficient for wet-processed 100% cotton yarn (TABLE I) as compared to the standard low friction wax-emulsion lubricant for textile yarns (Emulsion A). Similar results (29.4% reduction) are set forth in TABLE II, wherein 50% cotton/50% polyester dry yarns were tested at different wet-pickup levels.

Table III below tabulates a comparison of friction results between the standard, Stantex WE-567 (Emulsion A), and Lubricant A, Emulsion C and Lubricant C in accordance with the invention, run on a Lawson Hemphill friction tester as described under "METHODS". As can be seen from this Table, the polymer additive of the invention reduces friction significantly below that of the standard, particularly in the case of Lubricant A.

TABLE III

| Dyed Cotton Yarn, wet and dry | | | | |
|---|---|---|---|---|
| | LAWSON HEMPHILL COF VALUES (μ) | | | |
| | INDIGO BLUE 40' S/2 | | GRAY 20' S/2 | |
| SAMPLE | WET | DRY | WET | DRY |
| UNTREATED | .195 | .230 | .230 | .225 |
| WAX DISC ONLY | .160 | .150 | .210 | .195 |
| LUBRICANT A (NO WAX DISC) | .140 | .148 | .140 | .130 |
| LUBRICANT A (WITH WAX DISC) | .140 | .140 | .140 | .135 |
| EMULSION C | .200 | .180 | .235 | .185 |
| LUBRICANT C | .220 | .180 | .210 | .185 |
| EMULSION A | .225 | .215 | .218 | .212 |

I claim:

1. A fiber lubricant consisting essentially of a low-friction lubricating component and an acrylamido-$C_1$–$C_6$-alkane sulfonic acid polymer or salt thereof having an average molecular weight of at least about 500,000.

2. The fiber lubricant of claim 1, wherein the average molecular weight of the polymer is from about 1,000,000 to about 10,000,000.

3. The fiber lubricant of claim 1, wherein the average molecular weight is from 3 to 4 million.

4. The fiber lubricant of claim 1, wherein the lubricating component is a silicone emulsion.

5. The fiber lubricant of claim 2, wherein the polymer is present in an amount of at least about 0.01 wt. % active polymer, based on the total weight of the lubricant.

6. The fiber lubricant of claim 5, wherein the polymer is present in an amount of from about 0.01 to 1.5 wt. % active polymer, based on the total weight of the lubricant.

7. The fiber lubricant of claim 3, wherein the polymer is an acrylamidomethylpropane sulfonic acid homopolymer, or water-soluble salt thereof.

8. The fiber lubricant of claim 6, further containing a corrosion inhibitor.

9. The fiber lubricant of claim 1, wherein the lubricating component is a polyethylene or paraffin wax emulsion.

10. A method for lubricating textile fibers for processing to reduce fiber-to-metal friction comprising treating the fibers with the lubricant of claim 1.

11. The method of claim 10, wherein the fibers are wet-processed.

12. The method of claim 10 wherein the fibers are 100% cotton or a cotton blend.

13. The method of claim 12, wherein the processing comprises high-speed knitting.

14. The method of claim 12, wherein the fibers have a moisture content of at least 6% by weight, based on the weight of the fibers.

15. A method for improving the lubricating effect of a lubricant for use on textile fibers to reduce fiber-to-metal friction during processing comprising incorporating an acrylamido-$C_1$–$C_6$-alkane sulfonic acid polymer additive having a molecular weight of at least 500,000 into the lubricant.

16. The method of claim 15, wherein the textile fibers are 100% cotton, or a cotton blend.

17. The method of claim 16, wherein the fibers contain from about 6 to 8% by weight water, based on the weight of the fibers.

18. The method of claim 15, wherein the lubricant is a silicone-based lubricant.

19. The method of claim 15, wherein the polymer has a molecular weight of from about 1,000,000 to about 10,000,000.

20. The method of claim 19, wherein from about 0.01 to 1.5% by weight polymer is incorporated into the lubricant.

21. The method of claim 15, wherein the textile fibers are cotton, polyester, rayon, nylon, acrylic or a blend of at least two of these fibers.

22. The method of claim 10, wherein the textile fibers are cotton, polyester, rayon, nylon, acrylic or a blend of at least two of these fibers.

* * * * *